US007261408B2

(12) United States Patent
Otter

(10) Patent No.: US 7,261,408 B2
(45) Date of Patent: Aug. 28, 2007

(54) PRINTING DEVICE WITH RADIATION SOURCE

(75) Inventor: Brian D. Otter, Richmond (CA)

(73) Assignee: OCE Display Graphics Systems, San Jose, CA (US)

( * ) Notice: Subject to any disclaimer, the term of this patent is extended or adjusted under 35 U.S.C. 154(b) by 230 days.

(21) Appl. No.: 10/921,801

(22) Filed: Aug. 20, 2004

(65) Prior Publication Data

US 2006/0038868 A1 Feb. 23, 2006

(51) Int. Cl.
*B41J 2/01* (2006.01)

(52) U.S. Cl. ..... 347/102; 347/103

(58) Field of Classification Search ..... 347/102
See application file for complete search history.

(56) References Cited

U.S. PATENT DOCUMENTS

2004/0114016 A1* 6/2004 Yokoyama ..... 347/102
2005/0057630 A1* 3/2005 Hiroki et al. ..... 347/100

* cited by examiner

*Primary Examiner*—Stephen Meier
*Assistant Examiner*—Ly T. Tran
(74) *Attorney, Agent, or Firm*—Birch, Stewart, Kolasch & Birch, LLP

(57) ABSTRACT

A printing device and method containing a carriage supporting print heads with a plurality of discharging elements to the image-wise forming of image dots of a marking substance on an a print medium, wherein the carriage is moveable in reciprocation in a main scanning direction and is also relatively displaceable with respect to the print medium in the sub scanning direction. Moreover, at least one radiation source is provided for irradiating the image dots of marking substance. The radiation source is designed such that the print medium with the dots formed thereon receives, in a traverse of the radiation source, a radiation dose which increases towards an edge of the dimension in the sub scanning direction of the area irradiated by the radiation source in the traverse.

12 Claims, 4 Drawing Sheets

PRINTING DEVICE WITH RADIATION SOURCE

FIELD OF THE INVENTION

The present invention relates to a printing device such as a printing or copying system employing print heads containing discharging elements, e.g. nozzles, for image-wise forming dots of a marking substance on an image-receiving member, where the marking substance is in fluid form when discharged and is thereafter exposed to a radiation source. In particular, the marking substance may be a UV curable ink, while the radiation source is a UV radiation curing source.

BACKGROUND OF THE INVENTION

Print heads employed in inkjet printers and the like usually contain a plurality of nozzles arranged in (an) array(s). The nozzles usually are placed substantially equidistant. The distance between two contiguous nozzles defines the nozzle pitch. In operation, the nozzles are controlled to the image-wise discharge of fluid droplets of a marking substance on an image-receiving member. When the printer is of the scanning type, the print heads are supported on a carriage which is moveable in reciprocation across the image-receiving member, i.e. the main scanning direction. In such printers, the print heads are typically aligned in the sub scanning direction perpendicular to the main scanning direction. In a traverse of the carriage across the image-receiving member a matrix of image dots of a marking substance, corresponding to a part of an original image is formed on the image-receiving member by image-wise activating selected nozzles of the print heads. The printed matrix is generally referred to as a print swath, while the dimension of this matrix in the sub scanning direction is referred to as the swath width. Usually, although not required, the printing swath is constant within a selected printing mode. When a part of the image is completed, the image-receiving member is displaced relative to the carriage carrying the print heads in the sub-scanning direction, enabling printing of a subsequent part of the image. When this displacement step is chosen equal to a swath width, an image can be printed in multiple non-overlapping swaths. An advantage of such approach is the high productivity as only a single printing stage is employed. However, the image quality may be improved by employing printing devices enabling the use of multiple printing stages. In the prior art two main categories of such printing devices can be distinguished, i.e. so-called "interlace systems" and "multi-pass systems".

In an interlace system, the print head contains N nozzles, which are arranged in (a) linear array(s) such that the nozzle pitch is an integer multiple of the printing pitch. Multiple printing stages, or so-called interlacing printing steps, are required to generate a complete image. According to this disclosure, the print head and the image-receiving member are controlled such that in M printing steps, M being defined here as the nozzle pitch divided by the printing pitch, a complete image part is formed on the image-receiving member. After each printing step, the image-receiving member is displaced over a distance of M times the printing pitch. Such a system is of particular interest because it allows one to achieve a higher print resolution with a limited nozzle resolution.

In a "multi-pass system", the print head is controlled such that only the nozzles corresponding to selected pixels of the image to be reproduced are image-wise activated. As a result an incomplete matrix of image dots is formed in a single printing stage or pass, i.e. one traverse of the print heads across the image-receiving member. Multiple passes are required to complete the matrix of image dots. In-between two passes the image-receiving member may be displaced in the sub scanning direction.

Both "interlace systems" and "multi-pass systems" as well as combinations thereof share the advantage of an improved image quality but also the inherent disadvantage of a lower productivity. In practice the majority of print jobs is executed in a multiple printing stage mode. Displacements between the image-receiving member and the carriage are executed in small increments, the increment usually being much smaller than a print swath width.

Often after being deposited on the image-receiving member, the image dots of a marking substance are subjected to irradiation by a radiation source which may be positioned laterally adjacent the carriage on the carriage itself or on a separate mount moveable in co-operation with the carriage. This may be done for several purposes including to prevent or control bleeding, to improve adhesion, in the case of a solvent based marking substance to remove the solvents, in the case of a radiation curable marking substance to set or cure the marking substance, etc. The radiation source(s) is (are) are mounted in such a way that all the marking substance deposited on the image-receiving member is exposed to radiation. For instance, in the case where the marking substance is an UV curable ink and the radiation source is a mercury vapor lamp, there is a minimum dose of energy that is required to cure the ink. As discussed above, in a multiple printing stage mode, the swath of ink jetted on the image-receiving member in one traverse of the carriage is typically much wider than the incremental displacement of the carriage relative to the image-receiving member. Hence, ink discharged from nozzles positioned on one side of the carriage in the sub scanning direction will be exposed to multiple doses of radiation while ink discharged from nozzles positioned on the opposite side of the carriage may only be exposed to a single dose of radiation originating from a single traverse of the lamp. As a consequence it may well be that the overall power output level of the lamp must be increased in order to ensure that all ink deposited, including the ink exposed by only a single traverse of the lamp, receives the minimum radiation dose required to cure the ink. Besides the fact that such ineffective use of additional power is environmentally unfriendly and costly, there may be some additional disadvantages associated with the use of an increased output power level. For instance, the increase in power level also results in an increase of heat which is particularly undesired when curing ink deposited on thermal sensitive image-receiving members. Moreover, part of the ink deposited is exposed to multiple traverses of the UV lamp, which output level is increased, and hence overcuring may occur as some inks are sensitive thereto.

SUMMARY OF THE INVENTION

It is an object of the present invention to provide a radiation source moveable in co-operation with the moveable carriage of a printing device which irradiates the deposited marking substance more effectively, particularly when the printing device is operated in a multiple printing stage mode.

It is a further object of the present invention to provide a radiation source moveable in co-operation with the moveable carriage of a printing device which ensures that all dots of marking substance deposited on an image-receiving member receive at least a predetermined minimum radiation dose, regardless of whether the printing device is operated in a single or multiple printing stage mode, without substantially increasing the overall output power level of the radiation source.

To meet these objects, according to the present invention, a printing device is disclosed which includes:

a carriage which is moveable in reciprocation in a main scanning direction, at least one print head having a plurality of discharging elements arranged in arrays for the image-wise forming of image dots of a marking substance on an image-receiving member, each print head being mounted on the carriage so that the arrays of discharging elements are aligned in a sub scanning direction perpendicular to the main scanning direction, displacement means for establishing relative movement between the carriage and the image-receiving member in the sub-scanning direction, and at least one radiation source for irradiating the image dots of marking substance formed on the image-receiving member, each radiation source being mounted adjacent the print head and having a dimension in the sub-scanning direction equal to or greater than the swath width of image dots formed by the print head on the image-receiving member in a traverse of the carriage across the image-receiving member in the main scanning direction, and being designed such that the image-receiving member with the dots formed thereon receives, in the traverse, a radiation dose which increases towards an edge of the dimension in the sub scanning direction of the area irradiated by the radiation source in the traverse. Each radiation source may be mounted on the carriage. Alternately, the radiation source may be mounted on a separate mount which is moveable in cooperation with the carriage In an embodiment of the present invention each radiation source is non-linear shaped. Particularly, in case each radiation source is an UV radiation source and the marking substance is an UV curable substance, the non-linear UV radiation source may be a xenon lamp or may be composed of a plurality of LED's or other UV emitting devices.

In another embodiment of the present invention, each radiation source is composed of a plurality of radiation units. Control means are provided for controlling each of the plurality of radiation units such that the radiation dose received by the image dots in an area on the image-receiving member increases towards an edge of the dimension in the sub scanning direction of the area irradiated by the radiation source in a traverse. Hence the control means control the radiation units such that different radiation units generate different output power levels. This control can be done by matching the output level of the respective radiation units to a predetermined output profile. Preferably each of the radiation units is a LED or a LED array.

BRIEF DESCRIPTION OF THE DRAWINGS

The present invention will become more fully understood from the detailed description given hereinbelow and the accompanying drawings, which are given by way of illustration only, and thus are not limitative of the present invention, and wherein.

DETAILED DESCRIPTION OF THE INVENTION

In relation to the appended drawings, the present invention is described in detail. Several embodiments are disclosed. Although in the embodiments disclosed, the marking substance is a UV curable ink and the radiation sources are xenon flash lamps, it is apparent that a person skilled in the art can imagine several other equivalent embodiments or other ways of executing the present invention. In particular, the marking substance may be any marking substance which can be discharged in fluid form including but not limited to a solvent or aqueous based ink, an UV curable ink, a liquid toner, and a hot melt ink. The radiation source may be a drying source including a halogen lamp or a curing source including mercury vapour lamps, xenon flash lamps, and LED's.

Figure 1:
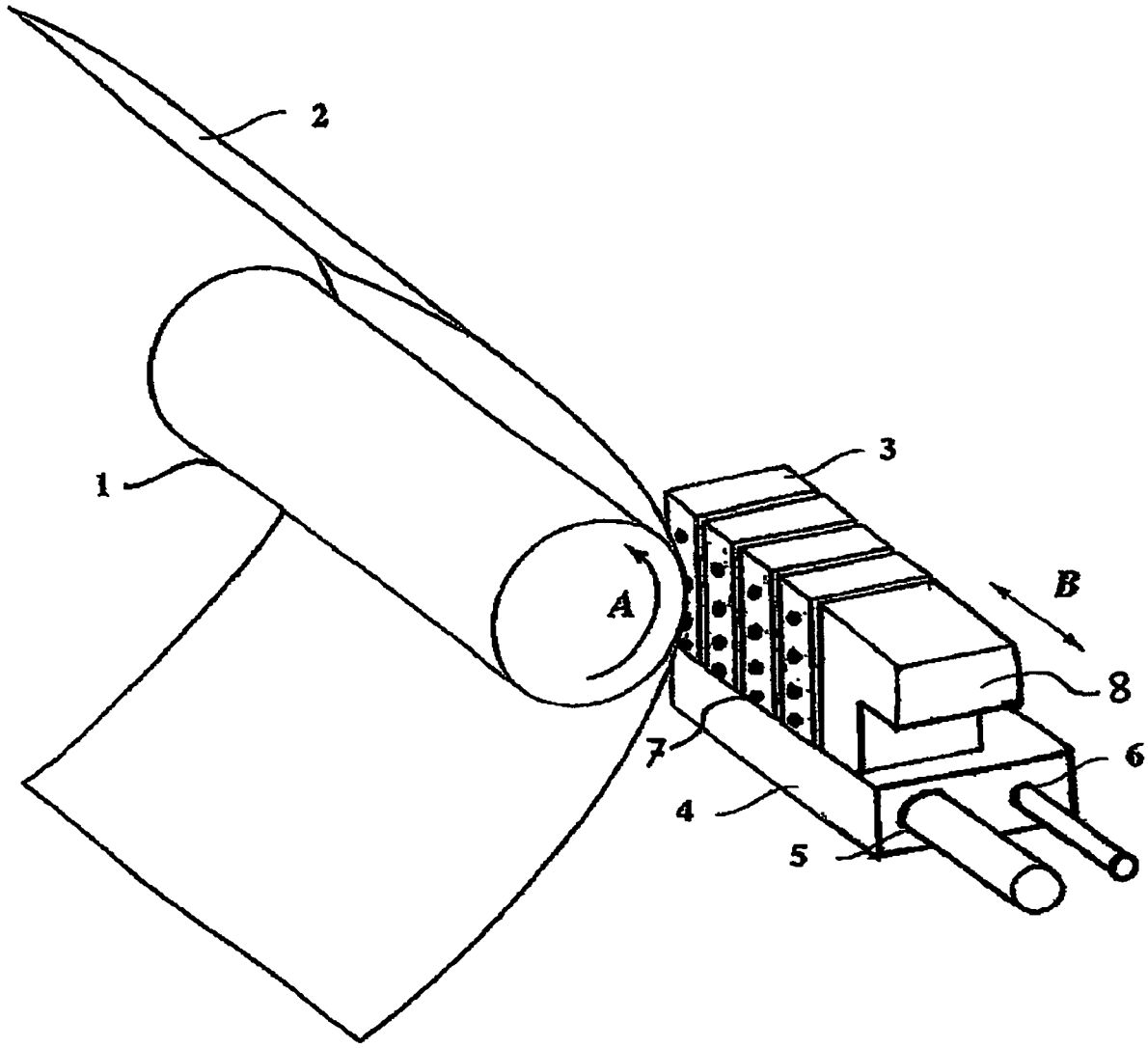
FIG. 1 depicts a scanning-type inkjet print provided with a radiation source according to the present invention.
Figure 2:
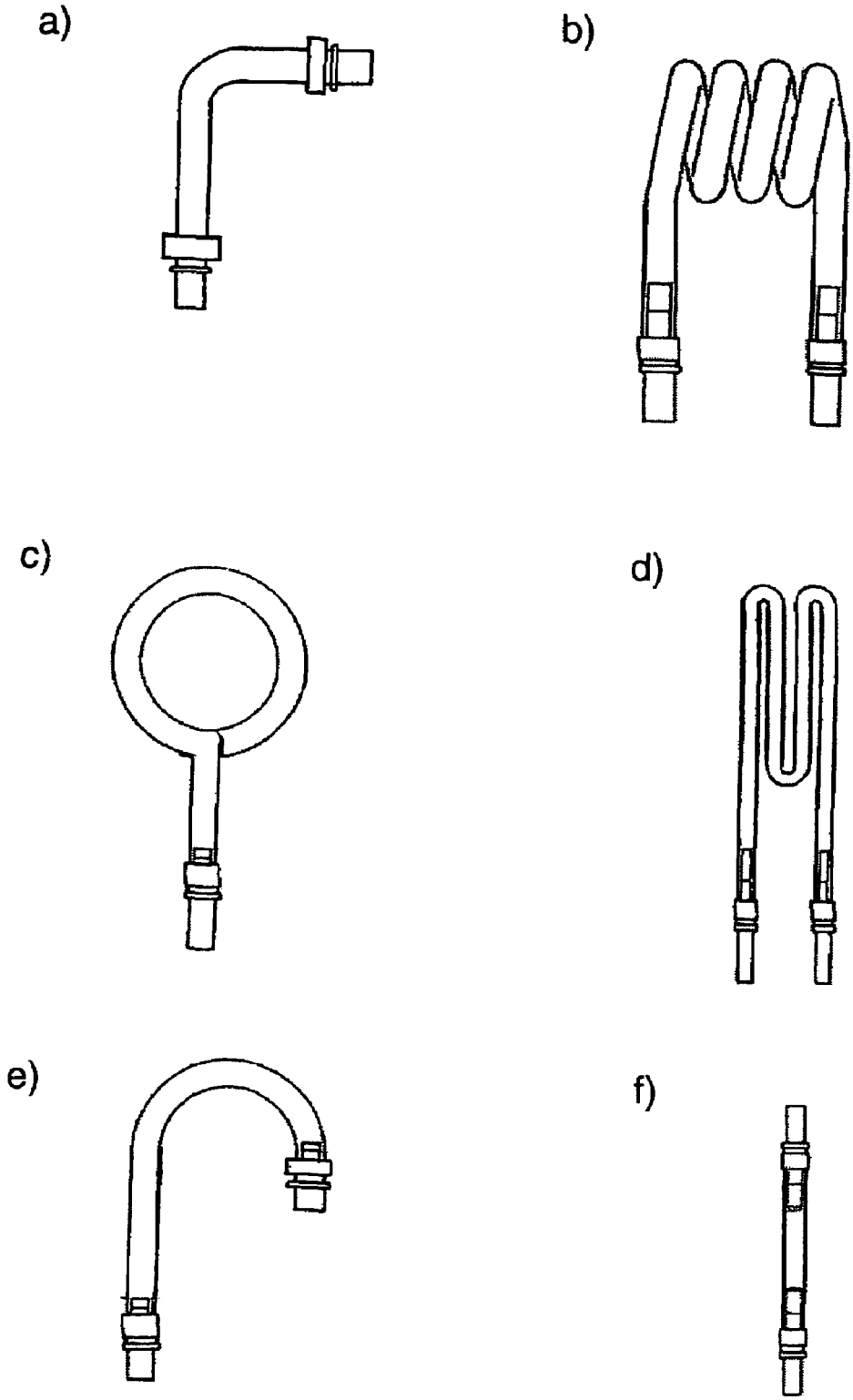
FIG. 2 depicts xenon flash lamps in different configurations for use as a radiation source in the printing device according to the present invention.

The printing device of FIG. 1 is an inkjet printer suited for printing with UV curable ink. The printing device comprises a roller (1) for supporting an image-receiving member (2) which is moved along four print heads (3), each having a different process color. The roller is rotatable about its axis as indicated by arrow A. A scanning carriage (4) carries the four print heads and can be moved in reciprocation in the main scanning direction, i.e. the direction indicated by the double arrow B, parallel to the roller (1), such as to enable scanning of the image-receiving member in the main scanning direction. The image-receiving member can be a medium in web or in sheet form and may be composed of e.g. paper, cardboard, label stock, plastic or textile. Alternately, the image-receiving member can also be an intermediate member which may or may not be endless. The carriage further supports a radiation source (8) for irradiating the ink dots. The carriage (4) is guided on rods (5) (6) and is driven by suitable means (not shown). Each print head comprises a number of discharging elements (nozzles 7) arranged in a single linear array parallel to the sub scanning direction. Four discharging elements per print head are depicted in the figure. However, in a typical, practical embodiment several hundred or several thousand discharging elements are provided per print head and are arranged in a single or multiple arrays. Each discharging element is connected via an ink duct to an ink reservoir of the corresponding color. Each ink duct is provided with means for activating the ink duct and an associated electrical drive circuit. For instance the ink duct may be activated thermally and/or piezoelectrically. When the ink duct is activated an ink drop is discharged form the discharge element in the direction of the roller (1) and forms a dot of ink on the image-receiving member. In operation, dependent upon the printing mode chosen, a print swath is formed by image-wise activating selected discharging elements in relation to the pattern(s) of pixels of an image or document to be reproduced, while the carriage is moved across the image-receiving member. The radiation source (8) schematically indicated in FIG. 1 irradiates at least the ink dots deposited during the print swath and has a dimension in the sub-scanning direction slightly greater than the width of image dots formed by the print heads on the image-receiving member in a traverse of the carriage across the image-receiving member. The radiation source used is a xenon flash lamp, i.e. a pulsed UV xenon lamp. Other arc lamps may also be used. An advantage of using a xenon flash lamp instead of other arc lamps is the low heat generated in operation making them particularly useful for the curing of ink deposited on thermal sensitive materials such as a thin film, a thin film core and a laminate. A further advantage is that xenon flash lamps have a wide-band radiation spectrum and hence a wider range of UV inks may be available as the spectral properties of the photoinitiator(s) used in these inks are less critical. A xenon flash lamp is typically fabricated from quartz or borosilicate. To ensure that, in a multiple printing stage mode, all the ink deposited receives a minimum curing dose, a xenon flash lamp is designed and positioned such that in operation the ink discharged from the upper nozzles receives a higher radiation curing dose in a single traverse of the lamp. This requirement originates from the fact that in a subsequent printing stage the image-receiving member is first advanced in the direction A, e.g. over a distance of half the width of the swath printed previously. Subsequently when the next swath is printed by scanning the carriage again over the image-receiving member, only the lower half of the ink dots of the previous swath will be re-exposed to the radiation source. This means that a part of the image dots formed only receives a radiation curing dose originating from a single traverse of the lamp. Thus, according to the present invention one can opt for a non-linear shaped xenon flash lamp instead of a linear lamp as depicted in FIG. 2*f*. As schematically indicated in FIG. 1 and FIG. 2*a* a substantially L-shaped lamp is used such that the ink dots deposited by the upper half of the nozzles receive about twice the radiation dose compared to the lower part of the nozzles. Doing so avoids an increase of the overall power output level of the lamp which would be detrimental when printing on heat sensitive media and which would negatively influence power consumption and life time of the UV radiation system. Moreover, in the case of UV curing, the energy that penetrates the deposited ink is a small portion of the energy that strikes the surface. Increasing the exposure time will increase the amount of energy that penetrates into the ink. The leg of the 'L' offers increased curing energy to the entire imaged area without any reduction in printing speed. Alternate shapes of the lamp can also be used including e.g., helical as in FIG. 2*b*, circular as in FIG. 2*c*, grid-like as in FIG. 2*d*, and candy cane as in FIG. 2*e*. The dimensions and position, particular of the non-linear part of the lamp, are chosen dependent on the size of the minimum advance of the image-receiving member, the direction of the advance, the number of printing stages and the minimum radiation dose required to completely or partially cure the deposited ink.

The UV radiation system typically includes drive electronics such as e.g. a high voltage power supply and a pulse generator for driving the lamp, UV optics to direct the generated light, including a housing and a reflector, optional cooling means, and a controller for controlling the UV radiation system to ensure that the lamp generates a predetermined output power level with a predetermined flash frequency. Typically the flash frequency is between 30 and 120 Hz.

Figure 3:
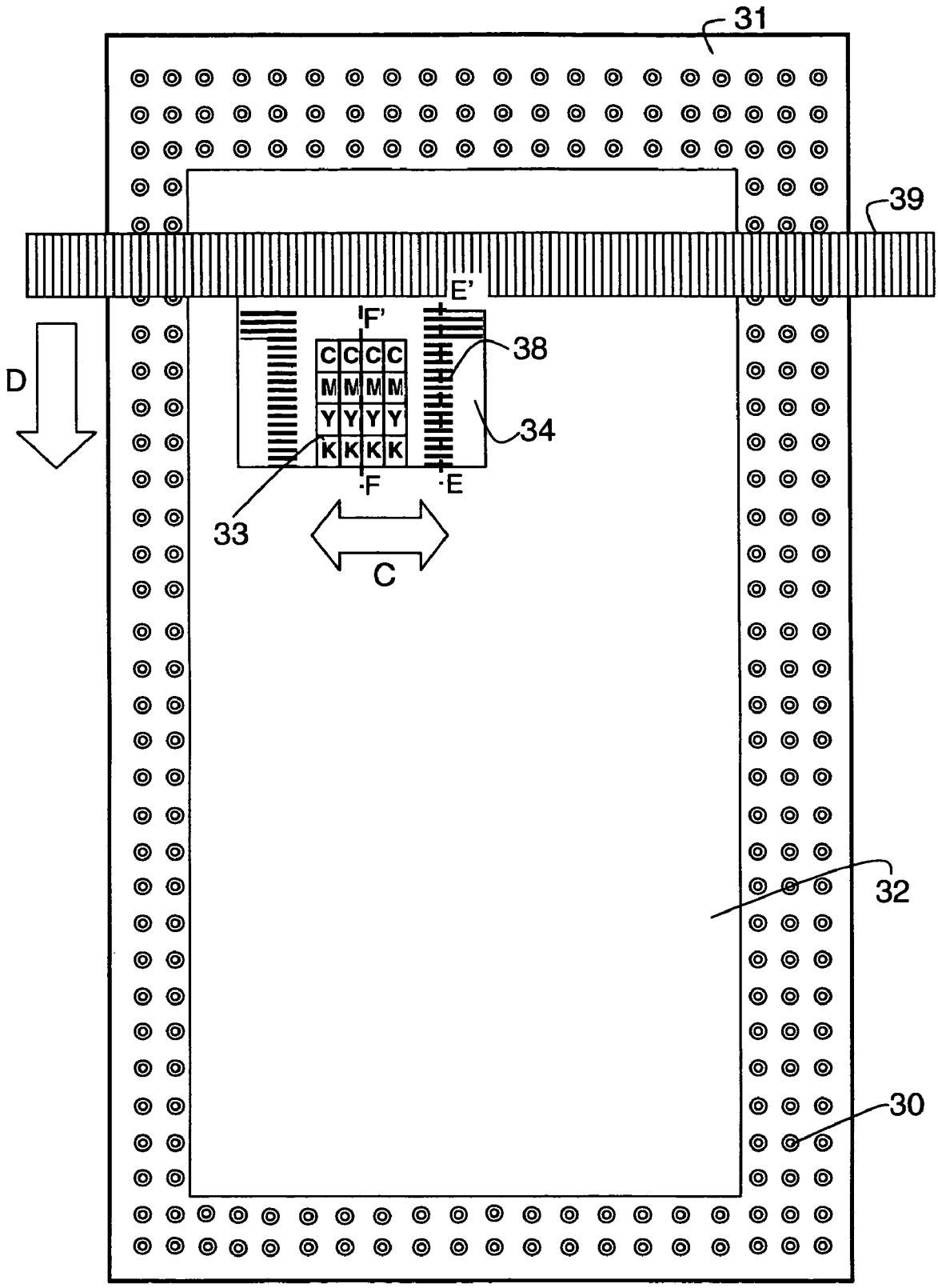
FIG. 3 depicts a flatbed inkjet printer provided with radiation sources according to the present invention.

The printing device of FIG. 3 is an inkjet printer of the flatbed type suitable for printing with UV curable ink. The printing device comprises a flat support table (31) for supporting and fixing an image-receiving member (32). Underneath the table is a reservoir where air is maintained at a pressure well below atmospheric pressure. The support table includes a perforated metal plate having an upper surface contacting the image-receiving member or an intermediate support carrying the image-receiving member. The perforations (30) cause the image-receiving member or the intermediate support to be sucked against the surface of the table. The perforations (30) in the metal plate have typically a diameter of about 1 mm. Typically about 400 perforations per $m^2$ are formed. In the upper surface of the metal plate, larger recesses are formed having a diameter of about 5 mm, each recess surrounding a perforation. Several print heads (33) are mounted on a carriage (34) which can be moved in reciprocation along a guide member extending across the image-receiving member, i.e. the main scanning direction.

The print heads (33) of a particular color, e.g. black (K), cyan (C), magenta (M), yellow (Y), are arranged in the main scanning direction, i.e. the direction indicated by double arrow C, while print heads of different colors are aligned substantially in the sub scanning direction as indicated by arrow D. Each print head comprises a number of discharging elements which are typically arranged in a single array or in multiple arrays in the sub scanning direction. Each discharging element is connected via an ink duct to an ink reservoir of the corresponding color. Each ink duct is provided with means for activating the ink duct and an associated electrical drive circuit. For instance the ink duct may be activated thermally, and/or piezoelectrically, or acoustic, or electrostatically. When the ink duct is activated an ink drop is discharged form the discharge element in the direction of the table (31) and forms a dot of ink on the image-receiving member.

The carriage further supports two radiation sources (38) for irradiating the ink dots deposited on the image-receiving member. The guide member may consist of two parallel cylindrical rods where the carriage is suspended on. The guide member and the carriage are both part of a gantry (39). This gantry can be moved back and forth along the image-receiving member, i.e. in the sub scanning direction. The support table (31) is kept stationary.

In operation the gantry is first displaced to an initial printing position such as e.g. the upper left corner of the support table. Then, dependent upon the printing mode chosen, a print swath is formed by image-wise activating selected discharging elements of the print heads in relation to the pattern(s) of pixels of an image or document to be reproduced, while the carriage is moved across the image-receiving member. The radiation sources (38) schematically indicated in FIG. 1 as element 8, irradiate at least the ink dots deposited during the print swath and overhang the print heads in the sub scanning direction. In other words, they have a dimension E-E' in the sub-scanning direction greater than the width F-F' of image dots formed by the print heads on the image-receiving member in a traverse of the carriage across the image-receiving member. The radiation sources, in casu L-shaped xenon flash lamps, are mounted to both sides of the carriage in such a way that all the ink jetted onto the image-receiving member is exposed to the radiation. The print heads are shielded to prohibit undesired exposure to UV irradiation. At the end of each print swath, the lamp positioned upstream with respect to the print heads is instantly switched off when crossing the edge of the image-receiving member or the support table to avoid reflections from and/or heating up of the support table. Subsequently, in the reciprocating movement the same lamp is instantly switched on and when reaching the opposite edge of the image-receiving member the other lamp is switched off. By doing so, print quality degradation due to undesired UV back reflections or warming up of the image-receiving member is avoided or at least effectively limited.

With UV curable inks there is a minimum dose of energy that is required to cure the ink. The swath of ink jetted in one traverse of the image-receiving member is typically much wider than the incremental advance of the carriage relative to the image-receiving member. The carriage is displaced in the sub scanning direction by displacing the gantry. As a consequence, with respect to the sub scanning direction, ink discharged from one side of the carriage will be exposed to multiple doses of radiation while ink jetted from the opposite side will be exposed to fewer traverses of the lamps depending on the additional length of the overhang of the lamps. However the L-shaped configuration of the lamps ensures that all the ink deposited receives at least a minimum radiation curing dose without increasing the output power level of the lamps. As already discussed with respect to FIG. 1 other non-linear shapes and/or other types of radiation source may also be used.

Figure 4:
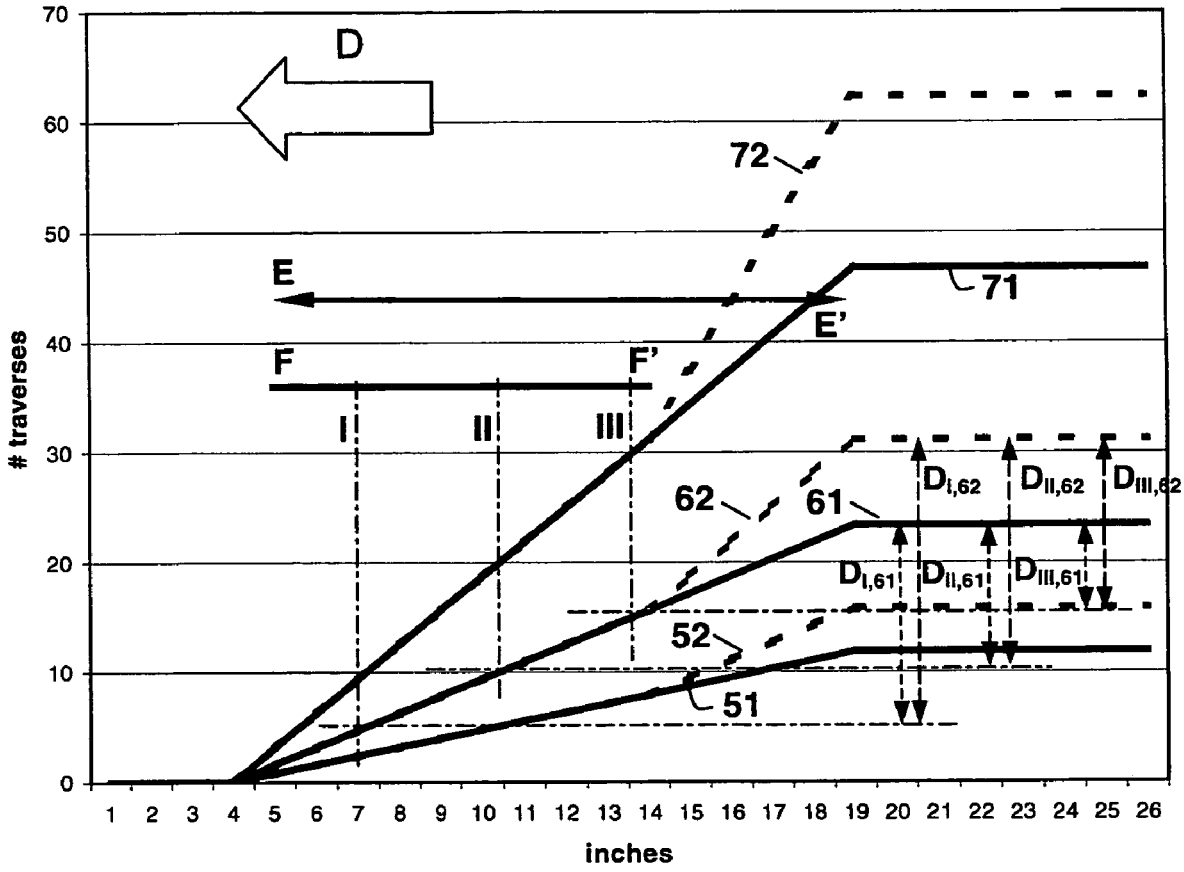
FIG. 4 is a graph depicting on the vertical axis the number of traverses of the carriage and on the horizontal axis the incremental advances of the carriage carrying the lamps and the print heads in the sub-scanning direction.

With reference to FIG. 3 and FIG. 4, the flatbed inkjet printer, as depicted in FIG. 3 and described above, is alternately provided with two linear pulsed UV xenon lamps and two non-linear shaped pulsed UV xenon lamps of the same length mounted laterally, adjacent the carriage. This printer is operated in a multiple printing stage mode where the incremental advance of the carriage in the sub scanning direction is smaller than a print swath width. This is to demonstrate the effect of introducing lamps shaped according to the present invention compared to linear shaped lamps on the radiation dose accumulated by the respective ink dots formed on the image-receiving member. In particular, the print swath width is 10.24 inches which is also the total length F-F' of the nozzle array formed by the respective print heads. The dimension E-E' of each of the pulsed UV xenon lamps in the sub scanning direction is 14.5 inches and hence the lamps overhang the print heads. The overhang distance is 4.26 inches. The radiation dose received by the ink dots deposited on the image-receiving member and originating from the nozzles along the nozzle array F-F' is a factor of the number of times the lamps pass over the deposited ink. This number of traverses is depicted on the vertical axis of FIG. 4 and depends on the printing mode and the advance increment of the carriage carrying the lamps and the print heads in the sub-scanning direction. The carriage is advanced in the sub scanning direction by advancing the gantry in direction D. As in this example the incremental advances in the sub-scanning direction are at least in an order of magnitude smaller than a print swath width, it is clear that the ink originating from the right hand side nozzles, i.e. the nozzles closer to position F', will accumulate a smaller dose of radiation energy than the ink originating from the left hand side nozzles, i.e. the nozzles closer to position F. The radiation dose received by an ink dot in number of traverses can be converted into a radiation dose expressed in number of flashes by taking into account the size of the advance of the gantry, the flash rate of the lamps, e.g., 120 Hz, and the speed of the traverse of the carriage in the main scanning direction, typically in the range of from 20 to 200 inches per second.

In FIG. 4 an arbitrary position in the sub scanning direction of the carriage/gantry with the print heads F-F' including the nozzles, and the lamps E-E' is indicated with respect to the image-receiving member on the support table. The horizontal axis of FIG. 4 depicts this position with respect to the image-receiving member in inches. The right hand side of the scale coincides with the start position of the gantry/carriage. The gantry will be advanced from right to the left, i.e., in the direction D. The radiation dose in number of traverses accumulated by each ink dot deposited, dependent upon which nozzle it originates from, is indicated for three different advance steps of the gantry, both with linear lamps (51)(61)(71) and with non-linear lamps (52)(62)(72). The curves (51)(52), (61)(62), (71)(72) depict the accumulated radiation dose using a gantry advance step of 1.28 inches, 0.64 inches and 0.32 inches respectively. The maximum radiation dose which can be accumulated per ink dot deposited, in the case of linear lamps with gantry increments of 1.28 inches (51) is about 12 traverses. With gantry increments of 0.64 inches (61) this is about 24 traverses, and with gantry increments of 0.32 inches (71) this is about 47 traverses. Assuming the printer is operated such that the gantry is advanced in steps of 0.64 inches (61), an ink dot which will be generated in the subsequent traverse of the carriage by a nozzle positioned at the left hand side of the nozzle array of the multiple print heads, i.e., nozzle I, will accumulate a radiation dose $D_{I,\ 61}$ of about 19 traverses which is close to the maximum dose which can be accumulated, in this case being about 24. An ink dot which will be generated in the subsequent traverse of the carriage by a nozzle positioned near the center of the nozzle array of the multiple print heads, i.e., nozzle II, will accumulate a radiation dose $D_{II,\ 61}$ of about 14 traverses. An ink dot which will be generated in the subsequent traverse of the carriage by a nozzle positioned near the right hand side of the nozzle array of the multiple print heads, i.e., nozzle III, will accumulate a radiation dose $D_{III,\ 61}$ of about 8 traverses. Further, assuming that the lamp and carriage are driven such that a minimum radiation curing dose is required corresponding to 10 traverses, the ink dots to be generated in the subsequent traverse of the carriage by nozzles close to the right hand side of the nozzle array, including the nozzle at position III, will receive an insufficient radiation curing dose in case linear lamps are used.

According to the present invention, the non-linear lamps are shaped such that in the overhang region about twice the exposure time is generated compared to the linear lamps and as a consequence an additional radiation dose will be received by all ink dots deposited. This additional exposure time in the overhang region results in a new equivalent maximum radiation dose which may be accumulated dependent upon the advance step of the gantry, which with gantry increments of 1.28 inches (52) is about 16 traverses, with gantry increments of 0.64 inches (62) is about 32 traverses, and with gantry increments of 0.32 inches (72) is about 63 traverses. Assuming again the printer is operated such that the gantry is advanced in steps of 0.64 inches (62), an ink dot which will be generated in the subsequent traverse of the carriage by a nozzle positioned at the left hand side of the nozzle array of the multiple print heads, i.e., nozzle I, will accumulate a radiation dose $D_{I,\ 62}$ of about 27 traverses. An ink dot which will be generated in the subsequent traverse of the carriage by a nozzle positioned near the center of the nozzle array of the multiple print heads, i.e., nozzle II, will accumulate a radiation dose $D_{II,\ 62}$ of about 22 traverses. An ink dot which will be generated in the subsequent traverse of the carriage by a nozzle positioned near the right hand side of the nozzle array of the multiple print heads, i.e., nozzle III, will accumulate a radiation dose $D_{III,\ 62}$ of about 17 traverses which is almost twice the radiation dose compared to $D_{III,\ 61}$ where linear lamps where used. Further, assuming that the lamp and carriage are driven such that a minimum radiation curing dose is required corresponding to 10 traverses, all ink dots deposited will receive a sufficient curing dose.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A printing device comprising:

a carriage which is moveable in reciprocation in a main scanning direction, at least one print head having a plurality of discharging elements arranged in arrays for image-wise forming image dots of a marking substance on an image-receiving member, said print head being mounted on the carriage so that the arrays of discharging elements are aligned in a sub scanning direction perpendicular to the main scanning direction, displacement means for establishing relative movement between the carriage and the image-receiving member in the sub-scanning direction, and at least one radiation source which is movable in reciprocation in a main scanning direction for irradiating the image dots of marking substance formed on the image-receiving member, said radiation source being mounted adjacent the print head, and having a dimension in the sub-scanning direction equal to or greater than the swath width of image dots formed by the print head on the image-receiving member in a traverse of the carriage across the image-receiving member in the main scanning direction, and said radiation source being designed such that the image-receiving member with the dots formed thereon receives in said traverse a radiation dose which increases towards an edge of the dimension in the sub scanning direction of the area irradiated by the radiation source in the traverse.

2. The printing device as recited in claim 1, wherein the radiation source is mounted on the carriage.

3. The printing device as recited in claim 1, wherein the radiation source is non-linear shaped.

4. The printing device as recited in claim 3, wherein the radiation source is an UV radiation source and the marking substance is an UV curable substance.

5. The printing device as recited in claim 4, wherein the UV radiation source is a xenon lamp or is composed of a plurality of LED's.

6. The printing device as recited in claim 1, wherein the radiation source is composed of a plurality of radiation units.

7. The printing device as recited in claim 6, further comprising control means for controlling each of the plurality of radiation units such that different radiation units generate different output power levels.

8. The printing device as recited in claim 7, wherein each of said radiation units is a LED or a LED array.

9. A printing device comprising:

a carriage which is moveable in reciprocation in a main scanning direction, a plurality of print heads for image-wise forming image dots of a marking substance curable with radiation on an image-receiving member, the print heads being mounted on the carriage so that at least one array of print heads is aligned in a sub scanning direction perpendicular to the main scanning direction, displacement means for establishing relative movement between the carriage and the image-receiving member in the sub-scanning direction, and at least one radiation source for curing the image dots of marking substance formed on the image-receiving member, said radiation source being mounted adjacent the print heads parallel to the sub-scanning direction, and having a dimension in the sub-scanning direction equal to or greater than the swath of image dots formed by the print heads on the image-receiving member in the traverse of the carriage across the image-receiving member in the main scanning direction, and said radiation source being designed such that image-receiving member with the dots formed thereon receives in said traverse, a radiation curing dose which increases towards an edge of the dimension in the sub scanning direction of the area irradiated by the radiation curing source in the traverse.

10. The printing device as recited in claim 9, wherein the or each radiation source is non-linear shaped.

11. A method of printing an image on an image-receiving member which comprises;

moving a carriage containing at least one print head in reciprocation in the traverse, in a main scanning direction across the image-receiving member, said print head being mounted on the carriage so that arrays of discharge elements are aligned in a sub-scanning direction perpendicular to the main scanning direction, establishing relative movement as displacement steps between the carriage and the image-receiving member in the sub-scanning direction, and irradiating image dots of marking substances formed on the image receiving member, said radiation source being designed such that the image-receiving member with the dots formed thereon receives a radiation dose which increases towards an edge of the dimension in the sub-scanning direction of the area irradiated by the radiation source in the traverse.

12. The method of claim 11, wherein the displacement steps of the carriage relative to the image-receiving member in the scanning direction are smaller than the swath width of image dots formed on the image-receiving member in the preceding traverse of the carriage.

* * * * *